United States Patent [19]

Day et al.

[11] 4,368,818

[45] Jan. 18, 1983

[54] CUPS FOR HOLDING INGREDIENTS FOR DRINKS

[75] Inventors: Robert H. Day, Brachnell, England; Gonzalo D. Vidal-Meza, Peoria, Ill.

[73] Assignee: Mono Containers (U.K.) Limited, Middlesex, England

[21] Appl. No.: 253,377

[22] Filed: Apr. 13, 1981

[51] Int. Cl.[3] ..... B65D 21/02; B65D 85/72; F28F 3/08; F28F 3/04

[52] U.S. Cl. ..... 206/217; 206/519; 206/520; 229/1.5 B; 72/385

[58] Field of Search ..... 206/217, 519, 520; 229/1.5 B; 165/166, 167; 29/157.3 D

[56] References Cited

U.S. PATENT DOCUMENTS 3,927,766 12/1975 Day ..... 206/217
4,124,120 11/1978 Day ..... 206/217
4,156,483 5/1979 Day ..... 206/217

*Primary Examiner*—George E. Lowrance

*Attorney, Agent, or Firm*—Oblon, Fisher, Spivak, McClelland & Maier; Sixbey, Friedman & Leedom

[57] ABSTRACT

A stackable thin-walled cup is designed to absorb telescoping loads with less risk of jamming and is for use in beverage dispensing machines with an ingredient held in the cup. As shown in FIG. 2 an ingredient is retained in the base 11 of the cup 1 which has an inward projecting annulus 6 with upper and lower surfaces 8 and 7 arranged to cooperate with surfaces 4 and 5 of an outwardly projecting annulus at the base of a second stacked cup. Surfaces 4 and 7 form a seal to prevent loss of ingredient and the two surfaces are held in contact by a force due to abutment between surfaces, 9 and 10 of respective cups. By suitable difference in linear dimension between surface 7 and abutment 10 and surface 4 and abutment 9 a force is produced by tension derived from the cup walls to hold the surfaces 4 and 7 together. Telescopic shock loads produce compression on the abutments 9 and 10 and momentarily separate surfaces 4 and 7 which re-engage on removal of the load.

10 Claims, 7 Drawing Figures

CUPS FOR HOLDING INGREDIENTS FOR DRINKS

BACKGROUND OF THE INVENTION

This invention relates to a cup for holding an ingredient for a drink and is principally concerned with thin walled cups of plastics material, a number of which may be nested together in a stack with a space being provided between the base of one cup in the stack and the next adjacent cup, which space may contain an ingredient in powdered form, for example. British Patent Specification No. 1,395,026 discloses such a cup. There are several requirements which have to be met in order to provide a useful article.

It is required to provide a seal above the ingredients contained in the one cup and which prevents the fine powders from contaminating the outer side walls of the other cup and prevents, at least to a substantial extent, the ingress of moisture and other contaminants from the atmosphere. It is also required to keep the faces forming the seal in contact during handling and for two adjacent cups to be retained so that a stack thereof does not become disassembled.

As each cup in the stack may contain upwards of twenty grammes of ingredients within the base then a stack of forty cups, as example, could weigh over eight hundred grammes and it is necessary to include a feature which reduces the tendency of the cups in the stack to jam or "telescope" together when subjected to axial shock loads such as being dropped or otherwise mishandled. It will also be understood that when the stack of cups is assembled into a vending machine then there must be a constant and pre-defined characteristic to the detachment of the lowermost cup from the stack.

DESCRIPTION OF PRIOR ART

In the forementioned specification No. 1,395,026 the two complementry angled conical surfaces forming a seal between an upper and a lower cup above the ingredient located in the base of the lower cup are maintained to contact by a slight force having both axial and radial components. If the upper cup is forcibly depressed then firstly there is an outward deflection of the lower side wall and seal of the lower cup as the sealing surfaces are forced into tighter contact, and then if the compression exceeds a certain degree the side wall may be totally deflected and the upper cup will become forced into the lower cup to become permanently jammed or telescoped together. In the prior described arrangement the two nested cups are held together by means of cooperating grooves and ridges in their upper side walls which inter-engage to provide retention of the two cups whilst maintaining the two conical sealing surfaces above the ingredient in engagement. The engaging grooves and ridges release on application of the pre-determined force to provide release of the bottom-most cup of the stack as required.

SUMMARY OF THE INVENTION

According to this invention there is provided a cup, a number of which may be assembled to form a stack with a space between adjacent cups in the stack adapted to hold an ingredient, the outer surface of the side wall of the cup in the region of the base having an annular projecting ridge of which an upper surface tapers conically upwardly and outwardly to form a first sealing surface, a further inwardly projecting annular ridge being provided in the side wall and spaced above the first ridge with a lower surface thereof tapering conically downwardly and inwardly to form a second sealing surface, the arrangement being such that when one cup is nested within another the projection near the base of the upper cup may engage below the inward projection of the lower cup with the first and second sealing surfaces engaging to isolate an ingredient located in the space between the base of the upper cup and base of the lower cup, the first and second sealing surfaces being held in engagement by an abutment provided on the inner surface of the upper side wall of the cup which, when the cups are heated, contacts a second abutment provided on the outer surface of the side wall of the cup below the first said abutment, the longitudinal distance between the abutments and the sealing surfaces being such that a tension is provided in the side wall of the upper cup which acts to maintain the first and second sealing surfaces in contact up to a certain loading applied to the stack.

The abutment towards the top of the cup may be constructed as a relatively sharp angular corner contacting a sloping shoulder forming the second abutment which provides better resistance to compressive forces applied to the stack. The arrangement of these features may be reversed so that the sloping shoulder is then formed above the sharp angular corner. Furthermore, any compression of the stack will initially cause the first and second sealing surfaces to part, the seal being restored when the force is removed. The dimensions between the abutments and sealing surfaces are arranged so that the abutment points meet prior to full engagement of one sealing surface below the other. This feature provides for a force to exist, which may be predetermined with accuracy, between the two sealing surfaces. A particular feature of this arrangement is that upon axial shock loading there is no radial distortion of the cups in the stack in the region of the seal, any distortion occurring due to compression being at the abutment surfaces, and jamming of the sealing faces is thus prevented.

BRIEF DESCRIPTION OF THE DRAWINGS

Embodiments of cups in accordance with this invention are now described by way of an example an in conjunction with the accompanying drawings, wherein.

DESCRIPTION OF PREFERRED EMBODIMENTS

Figure 1:
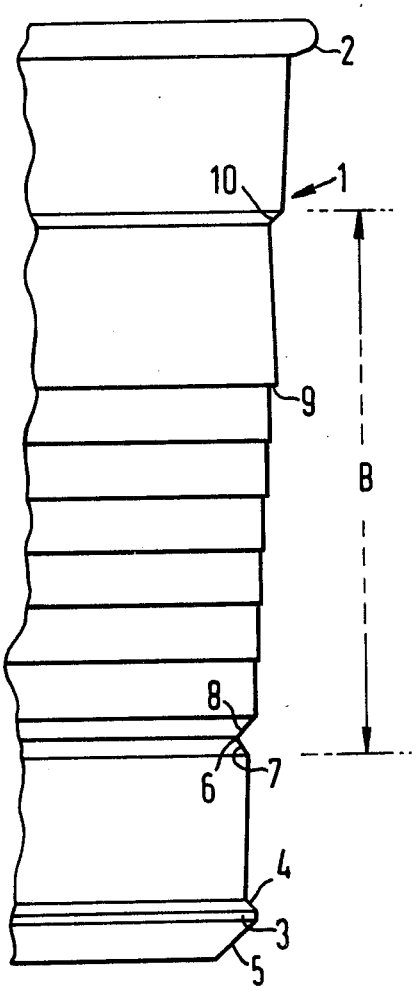
FIG. 1 shows a side elevation of part of a cup.

Referring to FIGS. 1 to 5 of the drawings, these depict a thin walled nestable cup of a plastics material formed by a known process. The cup 1 includes an upper rim 2 formed by rolling over the top portion and has, at the base, an outward projection 3 which is of annular form and includes an upwardly facing first sealing surface 4. The projection also merges with the base through a downwardly facing conically angled surface 5. In the side wall of the cup located above the projection 3 is a second inwardly directed projection 6 which defines a downwardly directed second sealing surface 7 which is of conical form and complementary to the first sealing surface 4. The projection also has a conically tapering upwardly directed surface 8.

Figure 3:
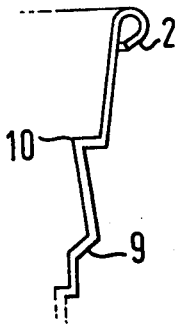
FIG. 3 shows a part vertical section through the side wall of a modified cup.
Figure 4:
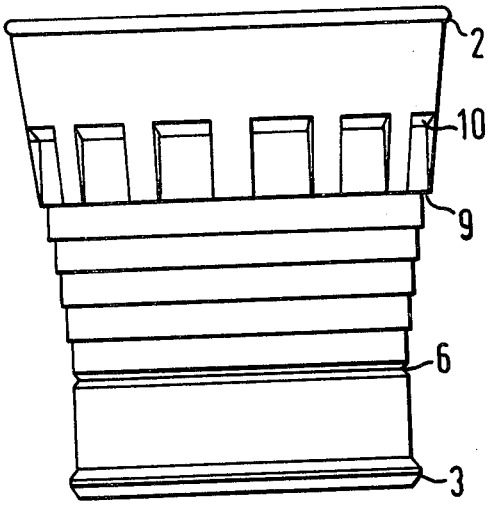
FIG. 4 shows, in side elevation, a cup similar to that of FIGS. 1 and 2 but with discontinuous abutment surfaces.
Figure 5:
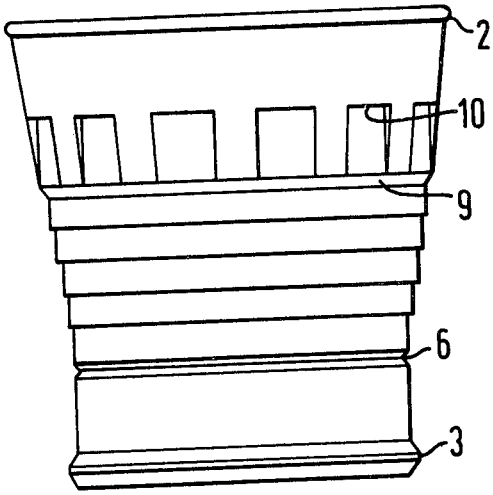
FIG. 5 is a cup as in FIG. 4 but modified in accordance with FIG. 3.

Towards the top of the side wall of the cup there is provided an outwardly extending abutment surface 9 and above that an inwardly directed abutment surface 10. The abutment surface 9 faces downwardly and the abutment surface 10 faces towards the mouth of the cup. The surfaces 9 and 10 may be reversed as shown in FIG. 3 and may also be formed as interrupted, non continuous surfaces, as a method of introducing additional axial resilience into the engaged cups. This is shown in FIGS. 4 and 5 as example.

Figure 2:
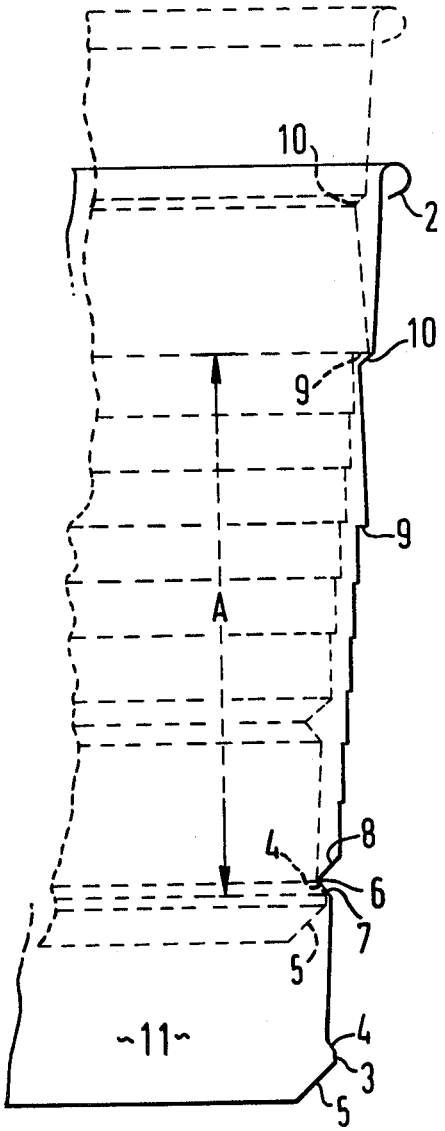
FIG. 2 shows a vertical section through the side wall of a cup with a stacked and engaged cup shown in broken lines.

Referring now to FIG. 2, one cup is shown nested and engages and in dotted lines within another cup and during the engaging process the surface 5 at the lower part of the inner cup is pressed downwardly so that it engages and slides over the upwardly facing surface 8 of the lower cup. The surface 5 slides over the surface 8 during which outward deflection of the side wall of the lower cup occurs until the position shown in the drawing is reached, wherein the first sealing surface 4 of the upper cup engages the second sealing surface 7 of the lower cup. It will be seen that in this condition the upper cup may be moved downwardly further into the second cup without any substantial deflection or distortion. In order to maintain the first and second sealing surfaces in engagement the abutment surfaces 9 and 10 are so arranged that the surface 9 of the upper cup contacts the surface 10 of the lower cup before full engagement of the sealing surfaces 4 and 7 occurs. In this way there is a constant upward compression force existing between the sealing surfaces 4 and 7, the extent of which depends on the relative spacing existing between the sealing surfaces and abutment points. An ingredient in powder form is thus trapped in the cavity 11. If the stack is subject to excessive compressional force than the upper side wall of the lower cup will be deflected outwardly through force exerted by the abutment 9 and to a certain extent into the lowermost cup. This movement merely produces separation of the two sealing surfaces during the time of the applied compression and, within limits, when the compressive force is removed the two sealing surfaces re-engage and remake the seal.

The abutments 9 and 10 may be designed so that they will absorb considerably more compressive force than in previously known constructions of cup and it can be seen that this arrangement provides the advantage that there is no deformation or damage to the actual sealing surfaces 4 and 7.

In the construction the distance A between the sealing surface 4 and abutment 9 will be less than the distance 8 between the sealing surface 7 and abutment 10.

Preferably an angle of forty five degrees is selected for the first and second sealing surfaces 4 and 7.

A further feature of the construction is that the contact between the first and second sealing surfaces does not depend on deformation of the side wall in the immediate vicinity of the surfaces as in known constructions.

The invention may also be applied to double walled containers and in such an arrangement the formation of the sealing and abutment surfaces is provided in the appropriate one of either the inner or outer wall of the cup. Such a double walled container is shown in FIGS. 6 and 7 of the drawings.

Figure 6:
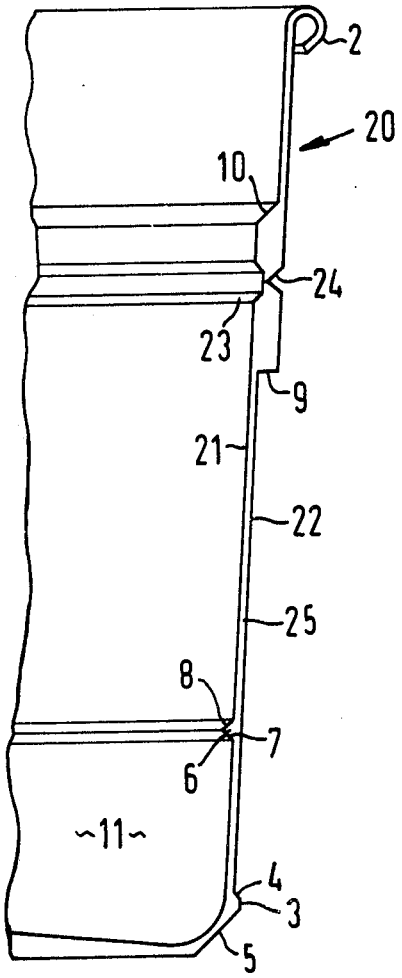
FIG. 6 shows a double walled cup in part vertical section.
Figure 7:
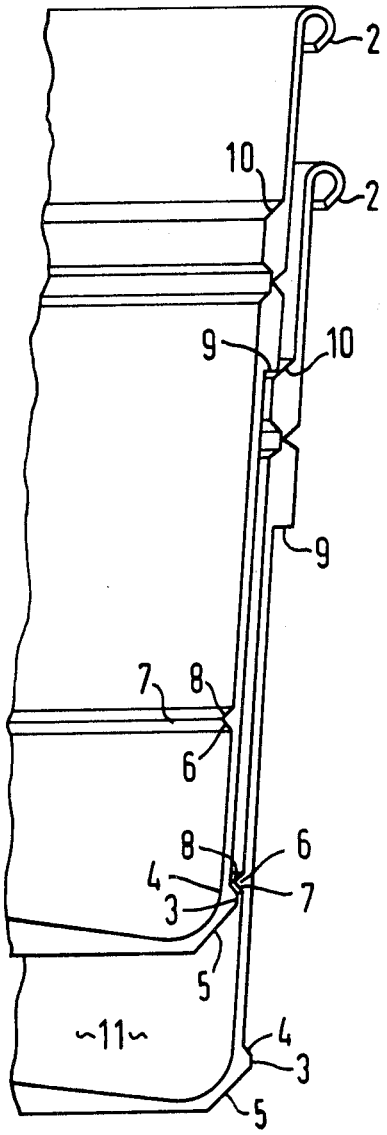
FIG. 7 shows two stacked double walled cups of FIG. 6.

Referring to FIGS. 6 and 7 a cup 20 has a composite wall formed by an inner wall 21 and an outer wall 22 which walls are connected at the rolled over lip 2. In these Figures like functional parts have the same reference numerals as are used in FIGS. 1 to 5. The two walls 21, 22 are spaced from one another by an outward annular projection 23 formed in wall 21 and an inward annular projection formed in wall 22. The spacing provides for an air gap 25 between the two walls serving as insulation.

The outer wall 22 includes the projection 3, first sealing surface 4 and angled surface 5 as well as the abutment surface 9 whilst the inner wall 21 is provided with abutment surface 10, projection 6, second sealing surface 7 and tapering upwardly directed surface 8. The various surfaces cooperate in a manner as previously described in conjunction with FIGS. 1 to 5 and FIG. 7 shows two engaged and stacked double-walled cups. 9n

I claim:

1. A cup of the kind of which a number may be assembled to form a stack of such cups with a space between the bases of adjacent cups in the stack, which space may be used for the packing of a beverage ingredient: wherein the outer surface of the side wall of the cup has near the base of the cup an annular outwardly projecting ridge including an upper surface which tapers conically upwardly and inwardly to form a first sealing surface, and the inner surface of the side wall has spaced about but near the outward projection an annular inwardly projecting ridge including a lower surface which tapers downwardly and outwardly to form a second sealing surface; and wherein the outer surface of the side wall has an outwardly extending abutment near the top of the cup and the inner surface of the side wall has an inwardly extending abutment spaced above but near the outward abutment; the arrangement being constructed such that when one cup is stacked inside a further such cup the first sealing surface of the upper cup engages beneath the second sealing surface of the lower cup to seal and thus isolate an ingredient in the space between the bottoms of the two cups and to resiliently resist separation of the two cups, the inward abutment of the lower cup engages beneath the outward abutment of the upper cup to resist further downward movement of the upper cup, and the side wall of the upper cup between the first sealing surface and the outward abutment is in tension whereas the side wall of the lower cup between the second sealing surface and the inward abutment is in compression.

2. A cup as claimed in claim 1, wherein the one abutment towards the top of the cup is formed by a sharp angular corner, the second abutment comprising a sloping shoulder.

3. A cup as claimed in claim 1, wherein the one abutment towards the top of the cup is formed by a sloping shoulder, the second abutment comprising a sharp angular corner.

4. A cup as claimed in claim 1, wherein the dimensions between the abutments and sealing surfaces are arranged so that the abutments and sealing surfaces are arranged so that the abutment points meet prior to full engagement of one sealing surface below the other.

5. A cup as claimed in claim 2, wherein the one abutment is formed by a plurality of discontinuous surfaces.

6. A cup as claimed in claim 5, wherein the discontinuous surfaces are each formed by an inwardly projecting portion of the side wall.

7. A cup as claimed in claim 1, wherein the side wall, at least, comprises two spaced wall surfaces defining therebetween an air gap, the annular projecting ridge in the region of the base and the second abutment being on the outer wall surface, the inwardly projecting annular ridge and the one abutment being in the inner wall surface.

8. A cup as claimed in claim 7, wherein the side wall comprises two spaced cup-shaped parts one within the other and secured together at their lips, with spacing means therebetween.

9. A cup as claimed in claim 8, wherein the spacing means comprises a projection on the inner or outer or both surfaces.

10. A stack of cups as claimed in claim 7, wherein a beverage ingredient is located in the base of the cups.

* * * * *